United States Patent [19]

Fingerson et al.

[11] Patent Number: 4,944,520

[45] Date of Patent: Jul. 31, 1990

[54] ARROW SHAFT END ADAPTOR APPARATUS AND BALANCE PIN APPARATUS AND METHOD

[75] Inventors: Conrad F. Fingerson; Bruce A. Nelson, both of Chatfield; Dennis L. Carlson, Brooklyn Park; Robert D. Eickhoff, Fountain, all of Minn.

[73] Assignee: AFC, Inc., Chatfield, Minn.

[21] Appl. No.: 248,216

[22] Filed: Sep. 26, 1988

Related U.S. Application Data

[63] Continuation-in-part of Ser. No. 102,028, Sep. 29, 1987, Pat. No. 4,874,180.

[51] Int. Cl.[5] ..... F42B 6/04

[52] U.S. Cl. ..... 273/419

[58] Field of Search ..... 273/416, 418–423

[56] References Cited

U.S. PATENT DOCUMENTS

| | | | |
|---|---|---|---|
| 213,083 | 3/1879 | Wright et al. | 273/420 X |
| 2,289,284 | 7/1942 | Chandler | 273/419 X |
| 2,516,341 | 7/1950 | Raffeis | 273/419 X |
| 2,613,936 | 10/1952 | Dalton | 273/419 |
| 2,747,876 | 5/1956 | Teller | 273/420 |
| 2,816,765 | 12/1957 | Stockfleth | 273/421 |
| 2,904,338 | 9/1959 | Podufal | 273/419 |
| 3,036,395 | 5/1962 | Nelson | 273/421 X |
| 3,425,695 | 2/1969 | Kestenbaum | 273/420 |
| 3,868,114 | 2/1975 | Groner | 273/419 |
| 4,050,696 | 9/1977 | Troncoso, Jr. | 273/420 |
| 4,166,619 | 9/1979 | Bergmann et al. | 273/421 X |
| 4,533,146 | 8/1985 | Schaar | 273/416 X |
| 4,615,529 | 10/1986 | Vocal | 273/421 |

FOREIGN PATENT DOCUMENTS 2443852 8/1980 France ..... 273/416

OTHER PUBLICATIONS

Bow & Arrow Hunting, 10/1985, p. 75, Precision Arrow Attachments.

*Primary Examiner*—Paul E. Shapiro

[57] ABSTRACT

An arrow and method of making it. The arrow has a hollow arrow shaft, a single piece adaptor having one end with an outer diameter and a cylindrical bore with an inner surface adhesively engageable about a first end of the shaft and an externally threaded opposite end. An inclined surface surrounds the externally threaded end and tapers inwardly from the outer diameter of the one end towards the bore. The inclined surface has a diameter greater than that of the external threads. The external threads and inclined surface receive and retain an arrow point with internal threads and inclined surface so that impact forces are not transmitted to the inner surface of the shaft. A balance pin has a shaft portion received in the arrow shaft, and a head portion interconnected to one end of the balance pin shaft portion. The head portion has a diameter greater than the shaft portion outer diameter and smaller than the inner diameter of the cylindrical bore. The method comprises the steps of: providing the end adapter and balance pin, inserting the balance pin shaft portion in the shaft opening until the balance pin head portion abuts the arrow shaft, adhesively engaging a portion of the inner surface of the adaptor bore with the outer surface of the shaft, threading an arrow point with an inclined surface on the externally threaded end of the adaptor, and contacting the inclined surface of the outer surface of the inclined point with the inclined surface of the adaptor.

2 Claims, 4 Drawing Sheets

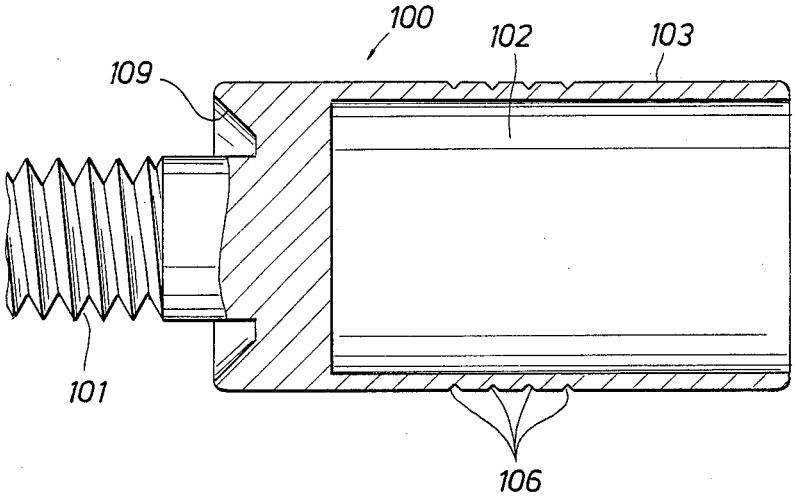
FIG. 1
FIG. 2
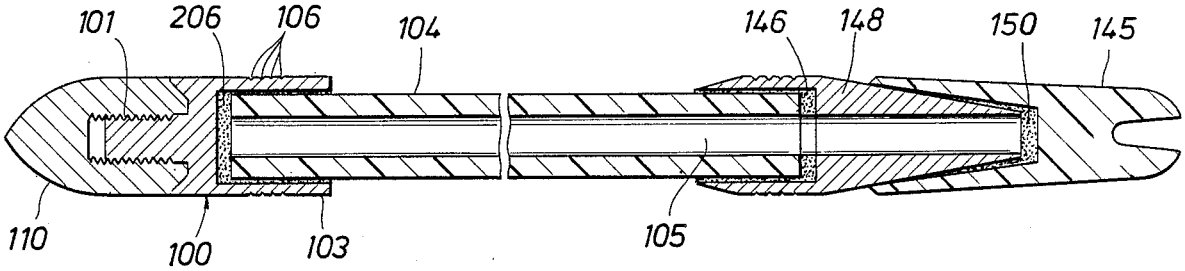
FIG. 6
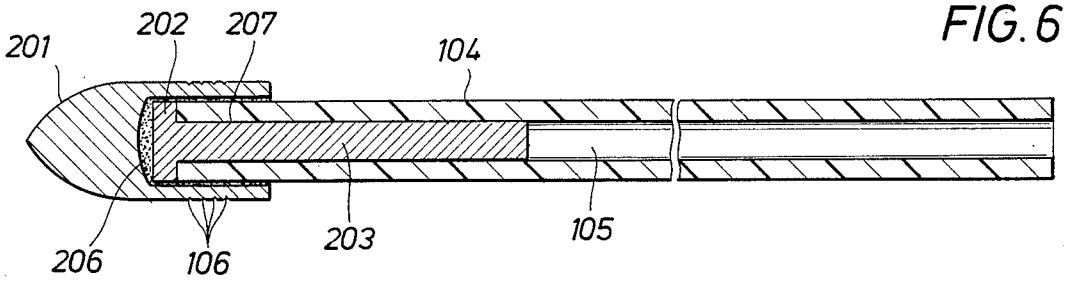
FIG. 7
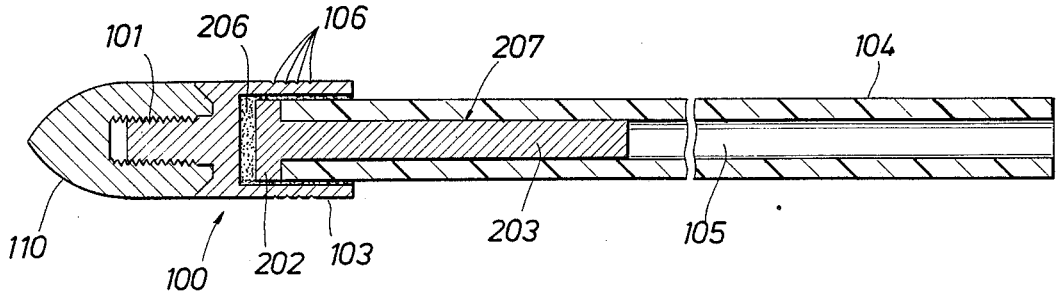

FIG. 15
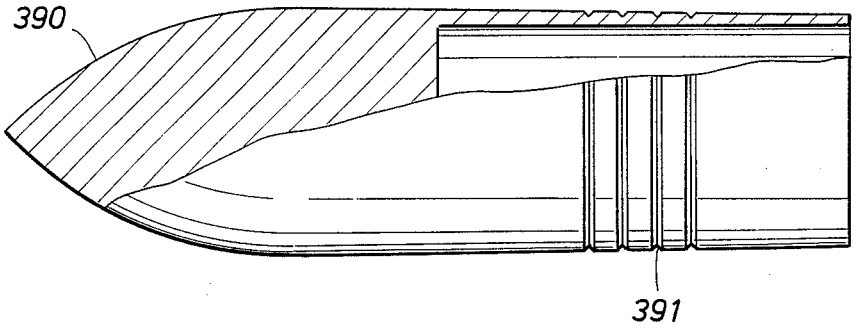
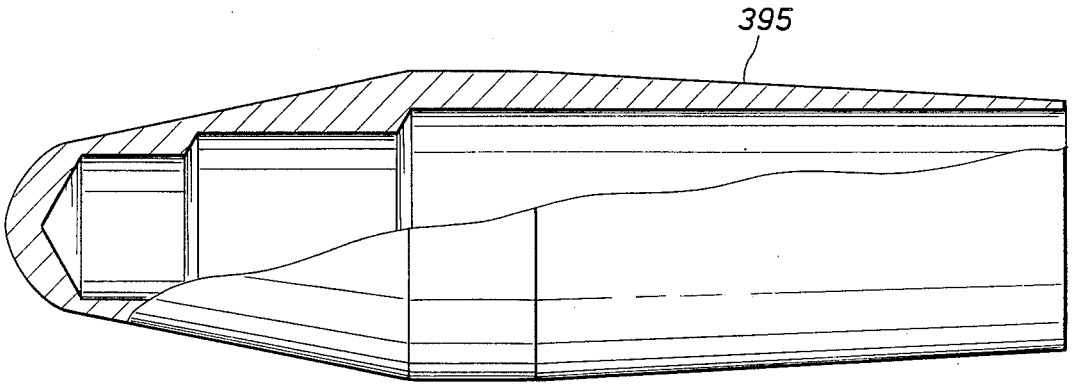
FIG. 16

ARROW SHAFT END ADAPTOR APPARATUS AND BALANCE PIN APPARATUS AND METHOD

This is a continuation-in part application of Ser. No. 102,028, filed Sept. 29, 1987, now U.S. Pat. No. 4,874,180.

BACKGROUND OF THE INVENTION

This invention relates to archery equipment and particularly to apparatus and methods for attaching arrow points and nocks to arrow shafts and for balancing arrow shafts.

The end adaptor apparatus and balance pin apparatus of the present invention are an improvement over prior art.

A balance pin may be inserted into the shaft at the end the arrow is attached, to provide the arrow with the proper balance. However, the balance pin must be fixed in the shaft so that its weight does not shift during flight, thereby adversely affecting the flight of the arrow.

The present invention solves these and other problems associated with the prior art.

SUMMARY OF THE INVENTION

It is therefore an object of this invention to provide a small lightweight point cap system that may be adjustable in weight so that perfect balance is easily obtained. In one embodiment, the point cap system comprises a point cap and a balance pin which can be varied in size so as to be of adjustable weight, The present invention provides a point cap system which is small and lightweight and greatly reduces the material and weight of the point or broadhead that may be attached. Light and slim graphite arrows perform and look best with smaller and lighter points than the industry standards.

The present invention also relates to a balance pin whose weight can be adjusted to balance an arrow shaft. Further, the present invention provides a point cap and balance pin design which works together. When the balance pin is used (and trimmed to the desired length), the exact point weight may be obtained giving the arrow perfect balance.

Also, the present invention relates to means to attach points to arrow shafts without allowing dirt to be able to enter the shaft when the arrow points are not attached.

This invention further attempts to have the threads receiving the arrow point placed on a point cap member such that if the threads are damaged, the point cap member may be replaced with a new threaded point cap member. Thus, the more expensive arrow shaft is not rendered useless.

The invention also relates to a means of attachment that is suited to the use of unidirectional fiber reinforced shafts. This invention utilizes the strength of the reinforcing fibers by reducing the cross fiber stress at the end of the shaft.

The present invention also relates to means for uniformly encapsulating or capping the end of an arrow shaft with a material that has nearly the same strength properties in all directions like steel or aluminum.

One embodiment of the present invention also relates to a point adaptor adhesively attached to the arrow shaft and having internal threads for threaded receipt of various types of arrow points having external threads.

The present invention also relates to a nock cap adaptor for attaching nocks to the end of an arrow shaft.

The present invention provides, in one embodiment, a target point and a balance pin as a one-piece unit, thereby insuring the point cap does not shift its weight during flight. The target point is affixed directly over the arrow shaft, either with an adhesive or a friction fit with crimps. Similarly, a nock cap is affixed to the arrow shaft.

These and various other advantages and features of novelty which characterize the invention are pointed out with particularity in the claims annexed hereto and forming a part hereof. However, for a better understanding of the invention, its advantages, and its objects obtained by its use, reference should be made to the drawings which form a further part hereof, and to the accompanying description matter, in which there is illustrated and described a preferred embodiment of the present invention.

BRIEF DISCUSSION OF THE DRAWINGS

In the drawings, wherein like reference numerals indicate corresponding parts throughout:

FIG. 1 is an enlarged sectional view of one embodiment of a point cap in accordance with the principles of the present invention;

FIG. 2 is a sectional view illustrating attachment of a field point to an arrow shaft by use of the point cap in accordance with the principles of the present invention

FIG. 6 is a sectional view of one embodiment of a balance pin attached to an arrow point and inserted into an arrow shaft in accordance with the principles of the present invention;

FIG. 7 is a sectional view illustrating an embodiment of an arrow shaft including the point cap and the balance pin;

FIG. 15 is an embodiment of an arrow point which slides onto an arrow shaft; and FIG. 16 is a nock adaptor affixable to the end of an arrow shaft.

DESCRIPTION OF THE PREFERRED EMBODIMENT

Figure 3:
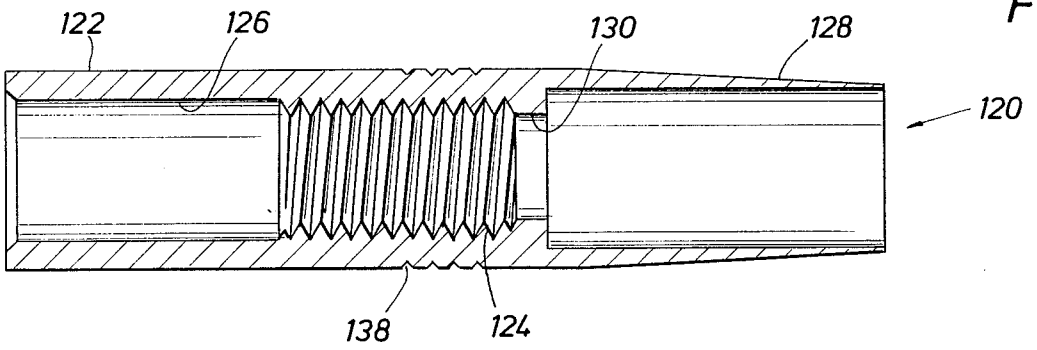
FIG. 3 is an enlarged sectional view of one embodiment of a point adaptor in accordance with the principles of the present invention.

Referring to the drawings, where like numerals apply to like parts, and more particularly to FIG. 1, an embodiment of an end adaptor, herein referred to as a point cap 100 may be seen. The point cap 100 is an integral, one-piece unit which includes an externally threaded end 101, to which an arrow point, such as a target point, a field point, or a broadhead point, with cooperating internal threads, may be secured as generally indicated in FIG. 2, wherein a field point 110 is shown attached to an arrow shaft 104 via the point cap 100. In the preferred embodiment, the point cap 100 is made from a hardened steel.

An opposite end portion 103, also referred to as a ferrule end, of the point cap 100 forms a cylinder with a hollow interior 102. Hollow interior 102 has a diameter such that the point cap slides over and is suitably affixed to the arrow shaft 104. The arrow shaft 104 shown in FIG. 2 is hollow and has a bore 105. In the preferred embodiment, the arrow shaft is made of graphite, glass or similar unidirectional reinforcing fibers. The point cap 100 may be affixed to the arrow shaft using an epoxy glue. The point cap 100 might include identification grooves 106 for identifying varying configurations of the point cap as may be used with varied sizes and configurations of arrow points, shafts, etc. The use of an externally attached point cap provides additional support to the end of the arrow shaft. The terminology ferrule, as used herein, refers to a bore with a surrounding cylindrical wall portion providing additional support to the shaft it cooperates with.

As opposed to internal threads for arrow point attachment, the use of external threads at the end of a cap is ideal for graphite shafts because stress is reduced at the end of the shaft.

Preferably, the point cap is permanently attached to the arrow shaft, however, in some embodiments the point cap might be attached with a less permanent adhesive such that if the threads are damaged, the point cap may be replaced with a relatively inexpensive new point cap, thereby preventing the loss of the more expensive arrow. In the preferred embodiment, the threaded end 101 has a lesser outside diameter than the outside diameter of the end portion 103 and the outside diameter of the arrow shaft 104. At the junction of the threaded end 101 and the end portion 103, the end portion 103 is circumferentially surrounded by an inclined surface 109 for cooperating with a similarly inclined surface of an arrow point.

Figure 4:
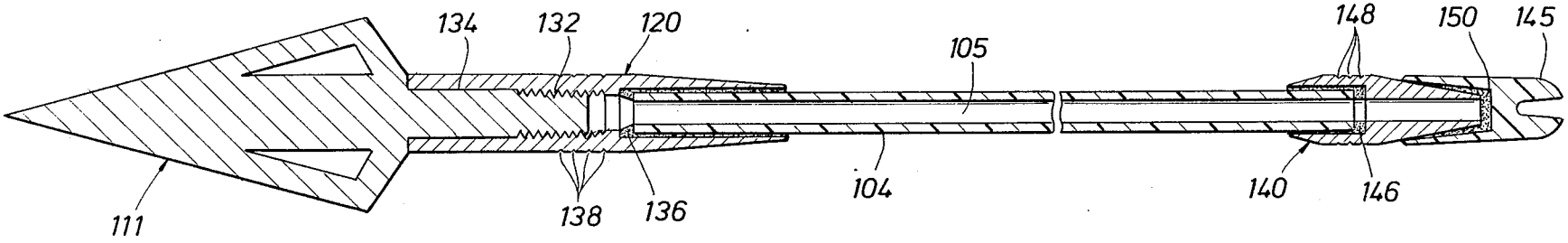
FIG. 4 is a sectional view illustrating attachment of a broadhead to an arrow shaft by use of the point adaptor shown in FIG. 3.

Illustrated in FIG. 3 is an embodiment of an internally threaded point adaptor 120 in accordance with the principles of the present invention. The point adaptor 120 is an integral, one-piece unit which includes a first end 122 including an internally threaded portion 124 and a hollow cylindrical bore portion 126. A second end 128 has an externally tapered surface and a bore configured for receipt of the arrow shaft 104, as generally illustrated in FIG. 4. The first and second ends 122, 128 are interconnected by a passageway 130 to allow the escape of air upon insertion of the arrow shaft 104 into the bore of the second end 128. In FIG. 4, a broadhead arrow point 111 is illustrated as being threaded into the threaded portion 124, a threaded portion 132 of the broadhead arrow point cooperating with the threaded portion 124 of the point adaptor 120. The broadhead arrow point 111 is shown further including a cylindrical portion 134 slidably received in the bore portion 126 of the point adaptor 120. The point adaptor 120 is preferably made of a light material such as aluminum. As illustrated in FIG. 4, the point adaptor 120 is preferably attached to the arrow shaft 104 by an adhesive 136 such as epoxy glue. In FIG. 4, the arrow shaft 104 is illustrated as being hollow, although it will be appreciated that the arrow shaft might also be solid. The point adaptor 120 might further include identifying grooves 138 for identifying differing configurations and sizes of the point adaptor 120.

Figure 5:
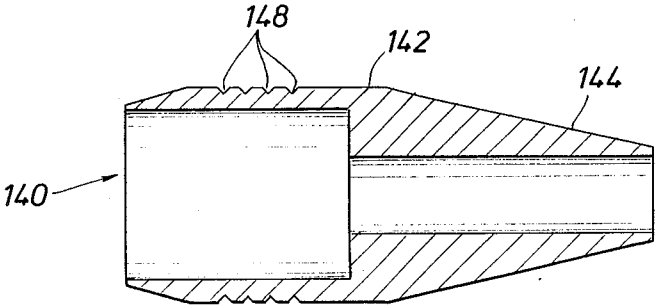
FIG. 5 is an enlarged sectional view of one embodiment of a nock cap in accordance with the principles of the present invention.

Illustrated in FIG. 5 is an embodiment of a nock cap 140 in accordance with the principles of the present invention. The nock cap 140 includes a first hollow cylindrical end 142 for slidable receipt on the arrow shaft 104 and a hollow tapered end 144 for insertion into a bore of a nock 145, as generally illustrated in FIG. 4. The nock cap 140 provides fluid communication between its ends such that upon insertion of the nock cap 140 onto an end of the arrow shaft 104, air can escape from the nock cap 140. The nock cap 140 is preferably made of a light material such as aluminum and is attached to the arrow shaft by an adhesive 146. The nock cap 140 might further include identifying grooves 148 as in the case of the point adaptor 120. The nock 145 is preferably made of a light material such as plastic and is attached to the nock cap 140 by an adhesive 150.

FIG. 6 refers to a balance pin 207 which may be used with an arrow point such as a target point 201. The balance pin 207 is affixed to the arrow shaft 104 by insertion into the arrow shaft 104 without necessitating the use of a threaded arrow shaft. A head portion 202 of the balance pin 207 is bonded to the interior of the arrow point 201 by adhesive 206. A shaft portion 203 of the balance pin 207 is inserted into the bore 105, of the arrow shaft 104. Preferably, the balance pin 207 is made of a heavy, soft metal such as brass, such that the balance pin shaft 203 may be cut off or trimmed to obtain a desired point weight. In the preferred embodiment, the balance pin 207 is an integral, one-piece unit. The balance pin 207 may also be used with a point cap by binding the balance pin to the interior of the point cap 100. In this way, it is possible to adjust the point weight.

The point cap 100 is used with an arrow shaft by suitably affixing the ferrule end 103 of the point cap 100 to the arrow shaft 104. An arrow point, such as a target point or broad head may be then threadedly attached to the point cap.

The balance pin 207 may be used with an arrow point having a hollow interior by affixing the head portion 202 of the balance pin 207 to the hollow interior of field point 201. The shaft 203 of the balance pin is then inserted into the arrow shaft bore 205 and encapsulated by the arrow point or the point cap by placement of an adhesive between the head portion of the balance pin and the arrow point or point cap. To prevent movement or vibration of the end cap in the arrow shaft, a small amount of adhesive might be placed on the shaft of the balance pin.

As illustrated in FIG. 7, the balance pin 207 may be used with the point cap 100 by suitably affixing the head portion 202 of balance pin 207 in the bore 102 of the ferrule end 103 of the point cap 100. The point cap 100 is then attached to the arrow shaft 104 such that the balance pin shaft 203 is in the interior of the arrow shaft 104.

Figure 8:
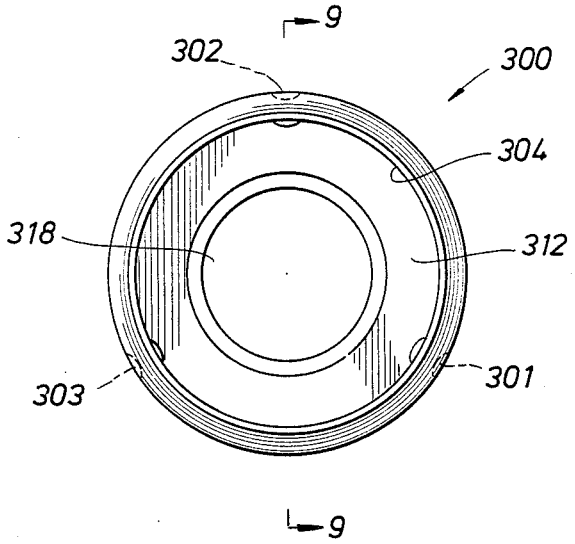
FIG. 8 is a sectional view illustrating an embodiment of a target point having crimps to secure the point to the shaft.
Figure 9:
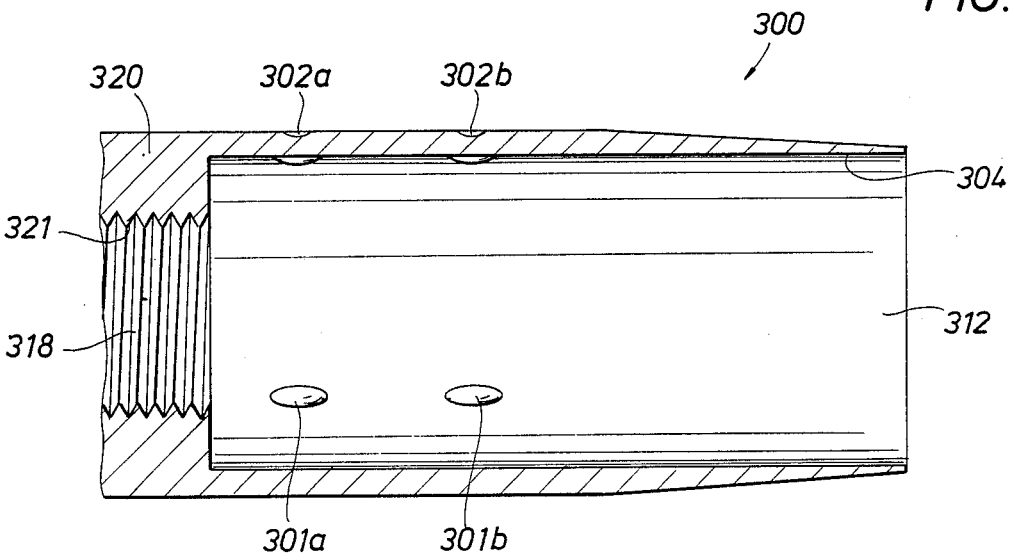
FIG. 9 is an enlarged sectional view of the embodiment shown in FIG. 8 as seen generally along line 9—9.
Figure 10:
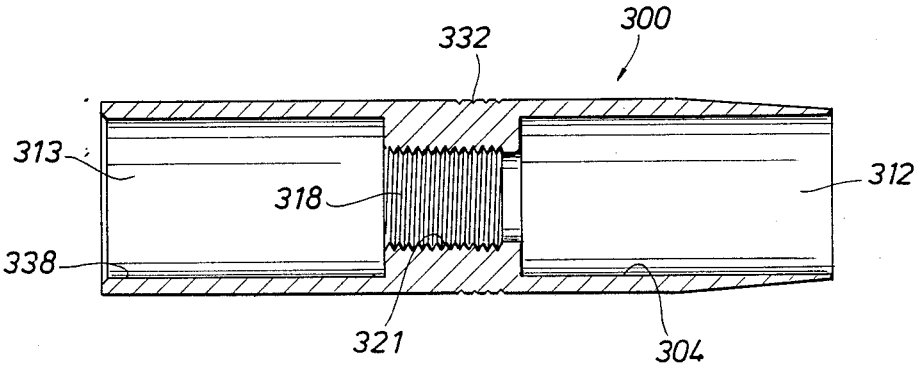
FIG. 10 is an enlarged sectional view of one embodiment of an end adaptor that uses an adhesive to secure the adaptor to the shaft.

FIGS. 8–10 show an alternate embodiment of an end adaptor 300. FIG. 8 shows a sectional view of the end adaptor 300 having internal crimps to allow the end adaptor to be slid over the shaft of an arrow and maintain its position on the arrow shaft. Similarly, an arrow point could be directly affixed to an arrow shaft. When implementing this embodiment of the invention, it is important to manufacture the target point or end adaptor precisely. The preferred embodiment uses crimps made to a tolerance of 0.001 inches. Internal wall 304 of the end adaptor is slid over the external shaft of an arrow. Equally spaced crimps 301, 302 and 303 help secure the end adaptor to the arrow shaft.

FIG. 9 shows a sectional view of a portion of the end adaptor 300. Internal cylinder 312 of the end adaptor 300 is affixed over an arrow shaft. This embodiment of the end adaptor 300 has two sets of crimps. Each set of crimps has three members positioned circularly and spaced equally around a circumference of an inner wall 313 of the end adaptor. Shown from this view are crimps 302*a,b* of the first set and 301*a,b* of the second set. A balance pin may be inserted into the hollow cylinder 312 before the hollow cylinder 312 is inserted over an end of an arrow shaft. The head of the balance pin is larger than the inner diameter of the arrow shaft bore and smaller than the diameter of the opening 318, and thus held in the correct position by walls 320.

FIG. 10 shows a sectional view of the internally threaded end adaptor 300 without internal crimps. Grooves 332 may be used to identify the end adaptor. The narrow opening 318 includes threads 321 for threaded attachment to an arrow point. A balance pin may be inserted into hollow cylinder 312 before the end adaptor 300 is affixed to an arrow shaft or the balance pin may be inserted in the hollow arrow shaft before the end adaptor is affixed. The shaft of the balance pin is then inserted into the hollow arrow shaft when the end adaptor is affixed to the arrow shaft. An arrow point is then threadedly attached to end 313 of the end adaptor, or in the alternative, end 313 of the end adaptor is inserted into a hollow arrow point. One embodiment of the present invention has the end adaptor and balance pin as an integral unit. The diameter of hollow cylinder 312 must be made with exacting tolerances so as to assure a proper fit and to insure that the end adaptor and point affixed to the end adaptor are aligned with the arrow shaft.

Figure 11:
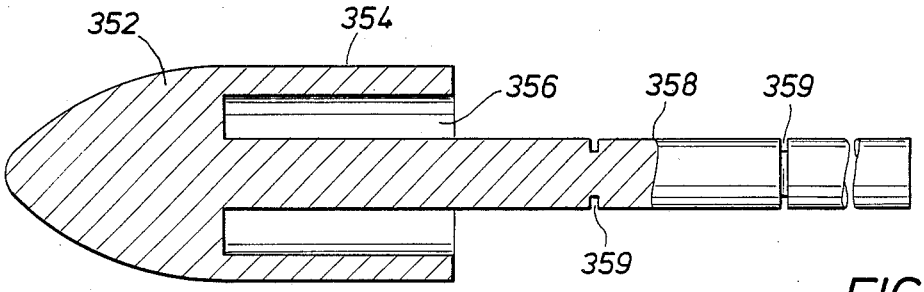
FIG. 11 is an enlarged sectional view illustrating an embodiment of an target point and balance pin as one unit.

FIG. 11 shows a target point and a balance pin that have been manufactured as a single unit 350. A point 352 of the target point is similar to the points of the prior art. Cylindrical shell 354 defines a hollow cylinder which may be affixed over the end of an arrow shaft or point cap adaptor. An arrow shaft is inserted in gap 356 created between the shell 354 and a balance pin shaft 358 attached to the point 352. The balance pin shaft 358 may be trimmed in length so as to provide target point assembly having weight chosen to balance the arrow. In the preferred embodiment shown, the balance pin shaft 358 has spaced apart grooves 359 extending circumferentially about the shaft 358. This allows the balance pin to be adjusted in 10% weight increments by breaking off the shaft of the balance pin at the grooves.

Figure 12:
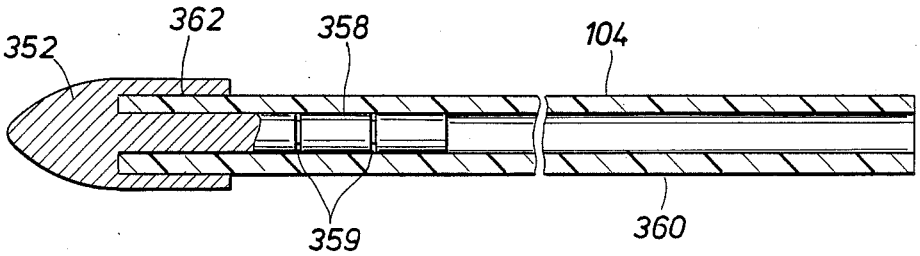
FIG. 12 is a sectional view illustrating an arrow having a single unit target point and balance pin affixed to one end of the arrow shaft.

FIG. 12 shows the single unit target point balance pin apparatus inserted onto a hollow arrow shaft 360. An adhesive 362 is applied to affix cylindrical walls of the target point 352 to the cylindrical walls of the arrow shaft.

Figure 13:
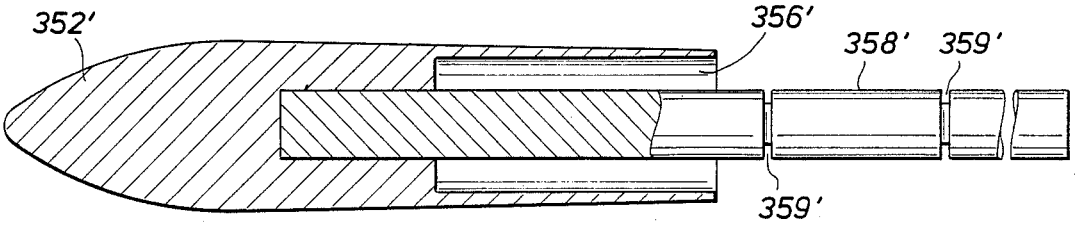
FIG. 13 is an alternate embodiment of a two piece target point and balance pin.

Shown in FIG. 13 is an alternate embodiment, wherein the point 352 is made of stainless steel and the balance pin shaft 358 is a steel drill rod press fitted in the point 352.

Figure 14:
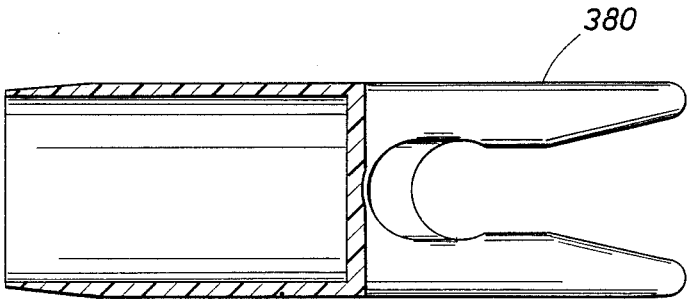
FIG. 14 is an embodiment of a nock which slides onto an arrow shaft.

FIG. 14 illustrates a plastic nock 380 which slides directly onto the shaft of an arrow and is adhesively attached thereto. FIG. 15 illustrates a steel arrow point 390, having identifying grooves 391, which slides directly onto an arrow shaft and is adhesively attached thereto.

FIG. 16 illustrates an aluminum nock adaptor 395 onto which a nock is mountable, the nock adaptor being mounted onto the arrow shaft.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An arrow, comprising:

(a) a hollow circular arrow shaft having a first end and a second end and an opening with an inner surface defined therethrough, (b) a single piece end adaptor for operative engagement to said hollow circular arrow shaft, said end adaptor having:

a cylindrical body having a ferrule end and an externally threaded end, said ferrule end having an outer diameter and a cylindrical bore with a continuous inner surface defined upwardly therein, the inner surface of said bore adhesively engageable about a portion of the first end of the circular arrow shaft;

said externally threaded end opposite said ferrule end having constant pitch and constant diameter external threads defined thereabout, and an inclined surface defined in a circular manner about the intersection of said ferrule end and said externally threaded end, said inclined surface tapered inward from said outer diameter of said ferrule end towards said bore of said ferrule end, said inclined surface having an inner diameter greater than the diameter of the constant diameter external threads, said external threads and said inclined surface formed to threadedly receive and retain an arrow point with cooperating constant pitch and constant diameter internal threads and inclined surface so that impact forces from the arrow point are not transmitted to the inner surface of said circular arrow shaft, and (c) a balance pin having a shaft portion with an outer diameter smaller than said opening defined through said arrow shaft, said balance pin shaft portion being received in a portion of said opening of said arrow shaft; and a head portion interconnected to one end of said balance pin shaft portion having a diameter greater than said balance pin shaft portion outer diameter, said balance pin head portion diameter being smaller than the inner diameter of said first ferrule end.

2. A method of making an arrow comprising the steps of:

providing a hollow circular shaft having a first end and a second end and an opening with an inner surface defined therethrough, providing a single piece end adaptor having:

a ferrule end with an outer diameter and a cylindrical bore with a continuous inner surface defined upwardly therein, the inner surface of said bore adhesively engageable about a portion of the first end of said hollow circular shaft; and an externally threaded end opposite said ferrule end, said externally threaded end having;

constant pitch and constant diameter external threads defined therabout, and an inclined surface defined in a circular manner about the intersection of said ferrule end and said externally threaded end, said inclined surface tapered inward from said outer diameter of said ferrule end towards said bore of said ferrule end, said inclined surface having an inner diameter greater than the diameter of the constant diameter external threads, said external threads and said inclined surface formed to threadedly receive and retain an arrow point with cooperating constant pitch and constant diameter internal threads and inclined surface so that impact forces from the arrow point are not transmitted to the inner surface of said circular shaft, providing a balance pin having a shaft portion with an outer diameter smaller than said opening defined through said arrow shaft, said balance pin shaft portion sized to be inserted into a portion of said arrow shaft opening, and a head portion interconnected to one end of said balance pin shaft portion having a diameter greater than said balance pin shaft portion outer diameter, said balance pin head portion diameter being smaller than the inner diameter of said first ferrule end, inserting said balance pin shaft portion in said arrow shaft opening until said balance pin head portion abuts said arrow shaft first end, adhesively engaging a portion of said inner surface of said bore of said ferrule end to the outer surface of said first end of said hollow circular shaft, threading an arrow point having an inclined surface on the externally threaded end of said end adaptor, and contacting said inclined surface of said arrow point with said inclined surface of said externally threaded end.

* * * * *